US010961814B2

(12) United States Patent
Roseman et al.

(10) Patent No.: US 10,961,814 B2
(45) Date of Patent: Mar. 30, 2021

(54) APPARATUS AND METHOD FOR ISOLATING FLOW THROUGH WELLBORE

(71) Applicant: Halliburton Energy Services, Inc., Houston, TX (US)

(72) Inventors: Matthew Brian Roseman, Duncan, OK (US); Shawn Ray Webb, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/099,633

(22) PCT Filed: May 24, 2016

(86) PCT No.: PCT/US2016/033872
§ 371 (c)(1),
(2) Date: Nov. 7, 2018

(87) PCT Pub. No.: WO2017/204784
PCT Pub. Date: Nov. 30, 2017

(65) Prior Publication Data

US 2019/0145218 A1 May 16, 2019

(51) Int. Cl.

| | |
|---|---|
| ***E21B 33/16*** | (2006.01) |
| ***E21B 33/129*** | (2006.01) |
| *E21B 33/128* | (2006.01) |

(52) U.S. Cl.
CPC ..... *E21B 33/16* (2013.01); *E21B 33/129* (2013.01); *E21B 33/128* (2013.01)

(58) Field of Classification Search
CPC .. E21B 21/10; E21B 21/103; E21B 2034/007; E21B 33/16; E21B 33/129; E21B 33/128
See application file for complete search history.

(56) References Cited

U.S. PATENT DOCUMENTS

| | | | | |
|---|---|---|---|---|
| 6,695,050 | B2 | 2/2004 | Winslow et al. | |
| 6,695,051 | B2 | 2/2004 | Smith et al. | |
| 6,749,023 | B2 | 6/2004 | Nguyen et al. | |
| 6,830,104 | B2 | 12/2004 | Nguyen et al. | |
| 7,234,522 | B2 | 1/2007 | Johnson et al. | |
| 7,357,198 | B2 * | 4/2008 | Mcgarian ..... | E21B 23/006 175/214 |

(Continued)

OTHER PUBLICATIONS

International Search Report and Written Opinion dated Feb. 20, 2017; International PCT Application No. PCT/US2016/033872.

*Primary Examiner* — David J Bagnell
*Assistant Examiner* — Yanick A Akaragwe
(74) *Attorney, Agent, or Firm* — McGuireWoods LLP

(57) ABSTRACT

A method includes conveying a wellbore isolation device into a wellbore, the wellbore isolation device including a primary valve arranged within a central flow passage. A fluid is then circulated through the central flow passage and into a tubing attached to a downhole end of the wellbore isolation device and in fluid communication with the central flow passage. The primary valve is moved from a first position to a second position and thereby diverts the fluid into an annulus defined between the wellbore and the wellbore isolation device. The primary valve may then be moved to seal the central flow passage and thereby prevent the fluid from flowing into the annulus or into the tubing.

20 Claims, 6 Drawing Sheets

(56) References Cited

U.S. PATENT DOCUMENTS

| | | | | |
|---|---|---|---|---|
| 7,841,417 | B2 | 11/2010 | Allison et al. | |
| 8,127,859 | B2 | 3/2012 | Allison et al. | |
| 9,145,748 | B1 | 9/2015 | Meier et al. | |
| 9,212,534 | B2 | 12/2015 | Ballew et al. | |
| 2007/0181313 | A1 | 8/2007 | Churchill | |
| 2008/0190620 | A1 | 8/2008 | Posevina et al. | |
| 2008/0314591 | A1 | 12/2008 | Hales et al. | |
| 2012/0261127 | A1* | 10/2012 | Zhou | E21B 21/103 166/289 |
| 2012/0261137 | A1 | 10/2012 | Martinez et al. | |
| 2013/0133891 | A1 | 5/2013 | Getzlaf et al. | |
| 2014/0124195 | A1* | 5/2014 | Tahoun | E21B 21/103 166/250.01 |

* cited by examiner

APPARATUS AND METHOD FOR ISOLATING FLOW THROUGH WELLBORE

BACKGROUND

In the drilling, completion, and stimulation of hydrocarbon-producing wells, a variety of downhole tools are used. For example, it is often desirable to seal portions of a wellbore during fracturing or cementing operations when various fluids and slurries are pumped into the well and hydraulically forced out into a surrounding subterranean formation. It thus becomes necessary to seal the wellbore and thereby provide zonal isolation. Wellbore isolation devices, such as packers, bridge plugs, and fracturing plugs (i.e., "frac" plugs) are designed for these general purposes. Such wellbore isolation devices may be used in direct contact with the formation face of the well or with a string of casing that lines the walls of the well.

A "squeeze packer" is one type of wellbore isolation device frequently used in wellbore cementing operations, such as plug-and-abandonment operations. A squeeze packer typically includes a fluid bypass system that allows a cement slurry to exit the squeeze packer via radial flow ports and thereby access portions of the well to be cemented. The fluid bypass system also prevents surge and swab effects when running and retrieving the squeeze packer.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to wellbore isolation devices and, more particularly, to wellbore isolation devices that allow fluid flow through a central flow passage until actuated to divert the fluid flow through radial flow ports.

The embodiments disclosed herein describe a wellbore isolation having a primary valve and a secondary valve and allowing flow through its inner diameter until the secondary valve is moved to seal the inner diameter. Once the secondary valve has sealed the inner diameter, the wellbore isolation device can function as a type of cement squeeze packer. The wellbore isolation device may allow a well operator to circulate a fluid through the wellbore isolation device prior to and after securing the wellbore isolation device within a wellbore. This may help remove debris from the wellbore and ensure that a packer assembly included in the wellbore isolation device can be set without obstruction.

Figure 1:
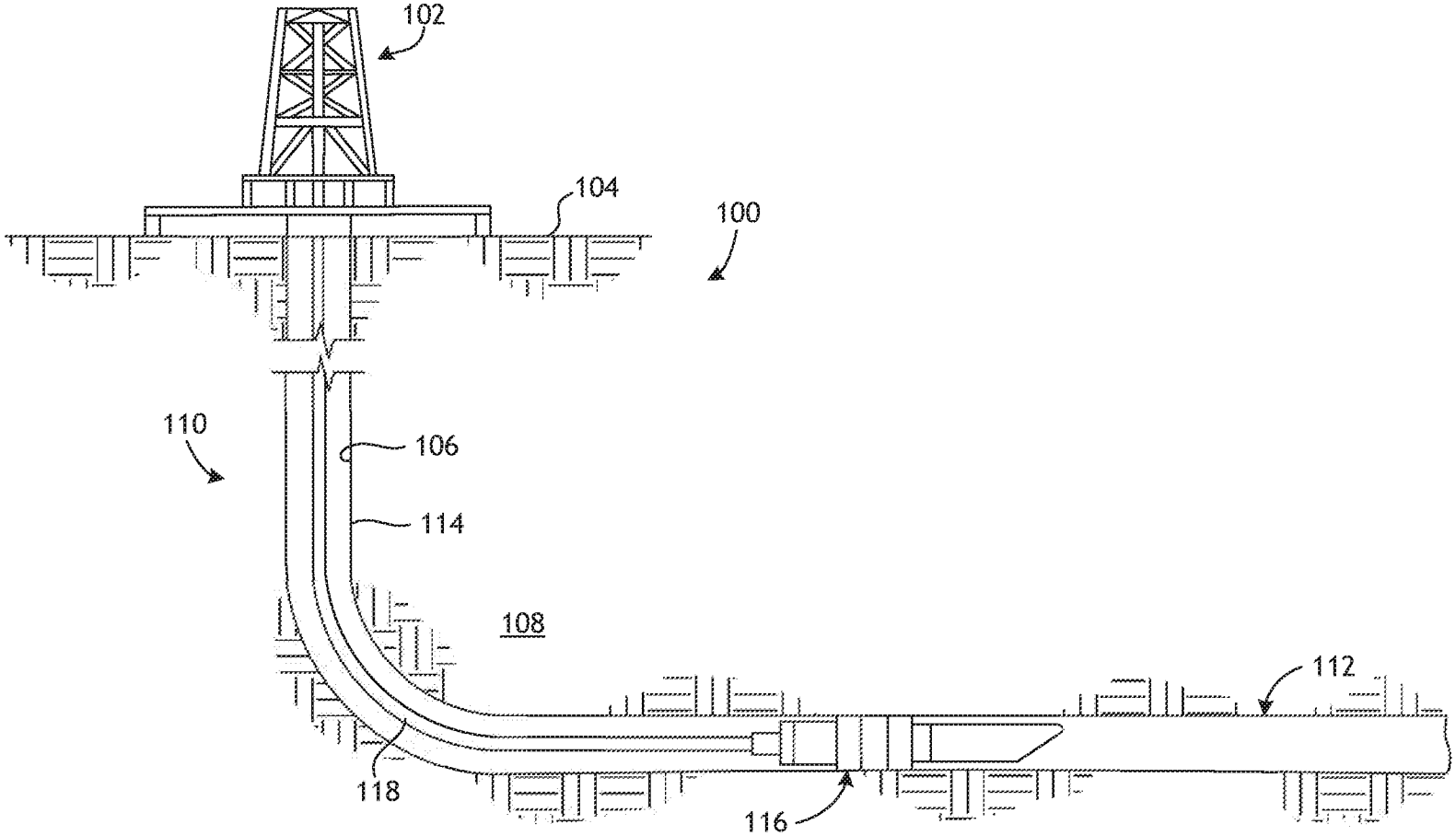
FIG. 1 is a well system that can employ one or more principles of the present disclosure.

FIG. 1 depicts an example well system 100 that may embody or otherwise employ one or more principles of the present disclosure. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. While the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof. In other embodiments, however, the casing string 114 may be omitted from all or a portion of the wellbore 106 and the principles of the present disclosure may equally apply to an "open-hole" environment.

The system 100 may further include a wellbore isolation device 116 that may be conveyed into the wellbore 106 on a conveyance 118 that extends from the service rig 102. The wellbore isolation device 116 may include or otherwise comprise any type of casing or borehole isolation device known to those skilled in the art including, but not limited to, a fracturing plug (i.e., a "frac" plug), a bridge plug, a wiper plug, a cement plug, a wellbore packer, a squeeze packer, a ball valve, or any combination thereof. The conveyance 118 that delivers the wellbore isolation device 116 downhole may be, but is not limited to, wireline, slickline, an electric line, coiled tubing, drill pipe, production tubing, or the like.

The wellbore isolation device 116 may be conveyed downhole to a target location within the wellbore 106 and actuated or "set" to seal the wellbore 106 and otherwise provide a point of fluid isolation within the wellbore 106. In some embodiments, the wellbore isolation device 116 is pumped to the target location using hydraulic pressure applied from the service rig 102 at the surface 104. In such embodiments, the conveyance 118 serves to maintain control of the wellbore isolation device 116 as it traverses the wellbore 106 and provides the necessary power to actuate and set the wellbore isolation device 116 upon reaching the target location. In other embodiments, the wellbore isolation device 116 freely falls to the target location under the force of gravity to traverse all or part of the wellbore 106.

It will be appreciated by those skilled in the art that even though FIG. 1 depicts the wellbore isolation device 116 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
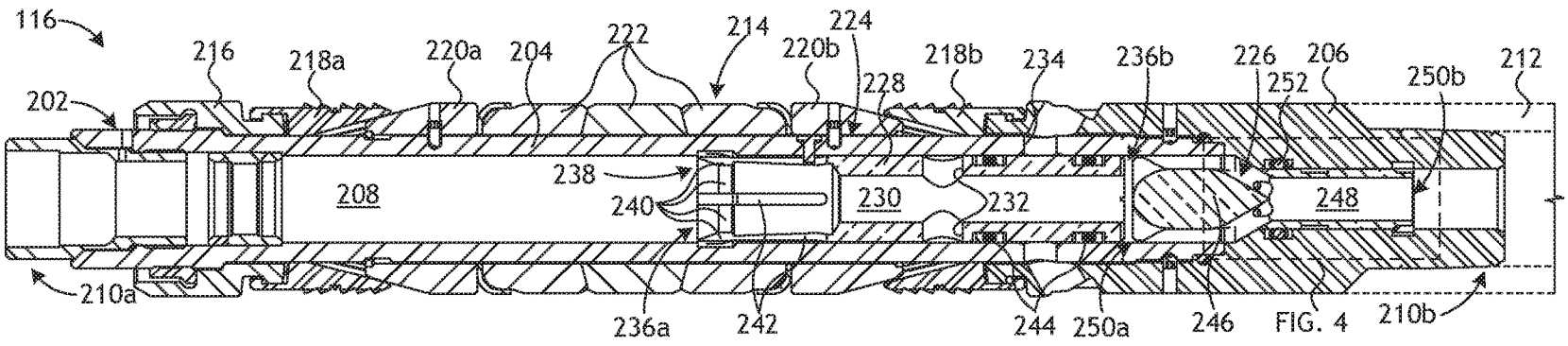
FIG. 2 is a cross-sectional view of an example embodiment of the wellbore isolation device of FIG. 1.

FIG. 2 is a cross-sectional view of an example embodiment of the wellbore isolation device 116 of FIG. 1. In some embodiments, the wellbore isolation device 116 may be configured to seal against the inner wall of the casing 114 (FIG. 1) that lines the wellbore 106 (FIG. 1), but could alternatively be configured to seal against the inner wall of the wellbore 106 in an open hole application. The wellbore isolation device 116 is generally depicted and described herein as a squeeze plug used in wellbore cementing operations, but it will be appreciated that the principles of this disclosure may equally apply to any of the other aforementioned types of wellbore isolation devices, without departing from the scope of this disclosure.

As illustrated, the wellbore isolation device 116 includes an elongate housing 202 defined generally by a mandrel 204 and a lower sub 206 coupled to the mandrel 204. The mandrel 204 and the lower sub 206 will be collectively referred to herein as "the housing 202." The housing 202 defines a central flow passage 208 and has a first or "uphole" end 210*a* and a second or "downhole" end 210*b* opposite the uphole end 210*a*. The housing 202 may be operatively coupled to the conveyance 118 (FIG. 1) at the uphole end 210*a*, and may be coupled to a string of tubing 212 (shown in dashed lines) at the downhole end 210*b*. The string of tubing 212 may comprise, for example, drill pipe or production tubing.

The wellbore isolation device 116 includes a packer assembly 214 arranged about the exterior of the housing 202 (i.e., the mandrel 204). As illustrated, the packer assembly 214 may include a spacer rings 216 disposed about the housing 202 and providing an abutment that axially retains a set of upper slips 218*a* also positioned circumferentially about the housing 202. The packer assembly 214 also includes a set of lower slips 218*b* arranged distally from the upper slips 218*a* and axially abutting an uphold end of the lower sub 206. One or more slip wedges 220 (shown as upper and lower slip wedges 220*a* and 220*b*, respectively) may also be included in the packer assembly 214 and positioned circumferentially about the housing 202 at an axially offset location from each other. Lastly, the packer assembly 214 may include one or more expandable or inflatable packer elements 222 arranged about the exterior of the housing 202 and positioned between the upper and lower slip wedges 220*a,b*. While three packer elements 222 are shown in FIG. 2, the principles of the present disclosure are equally applicable to wellbore isolation devices that employ more or less than three packer elements 222. It will be appreciated that the packer assembly 214 is merely representative as there are several packer designs and configurations that may be employed in keeping with the principles of the present disclosure.

The wellbore isolation device 116 also includes a primary valve 224 and a secondary valve 226, each positioned within the central flow passage 208 of the housing 202. The primary valve 224 may be configured to regulate fluid flow from the central flow passage 208 to the exterior of the housing 202, and the secondary valve 226 may be configured to regulate fluid flow from the central flow passage 208 into the tubing 212.

The primary valve 224 comprises a generally cylindrical body 228 that defines an inner flow path 230 and one or more radial flow ports 232 that are alignable with one or more lateral flow ports 234 defined in the housing 202 upon moving the primary valve 224. The inner flow path 230 is in fluid communication with the central flow passage 208 such that fluids passing through the central flow passage 208 are also able to enter the inner flow path 230 of the primary valve 224. The primary valve 224 is depicted in FIG. 2 as a sliding sleeve, but could alternatively comprise other types of valves, such as a ball valve, a poppet valve, a butterfly valve, or any combination thereof.

The body 228 of the primary valve 224 provides a first axial end 236*a* and a second axial end 236*b* opposite the first axial end 236*a*. A collet 238 may be provided at the first axial end 236*a* and may include one or more collet fingers 240 separated by longitudinally extending slots 242.

The primary valve 224 is axially movable within the central flow passage 208 between a first position and a second position. The primary valve 224 is shown in FIG. 2 in the first position, where the radial flow ports 232 are misaligned with the lateral flow ports 234 and thereby prevents fluid communication between the central flow passage 208 and the exterior of the housing 202. A pair of upper and lower seals 244, such as O-rings or the like, are arranged on opposing axial ends of the lateral flow ports 234 when the primary valve 224 is in the first position. The seals 244 provide a sealed interface between the primary valve 224 and the housing 202 that prevents fluids from passing through the lateral flow ports 234 when the primary valve 224 is in the first position. In the second position, however, the primary valve 224 is moved axially within the central flow passage 208 such that the radial flow ports 232 become aligned with the lateral flow ports 234 and thereby facilitate fluid communication between the central flow passage 208 and the exterior of the housing 202.

The secondary valve 226 is axially offset downhole from the primary valve 224 within the central flow passage 208. The secondary valve 226 provides an elongate body 246 that defines an inner flow path 248 and has a first axial end 250*a* and a second axial end 250*b* opposite the first axial end 250*b*. As discussed below, the secondary valve 226 is axially movable within the central flow passage 208 between a first position and a second position. The secondary valve 226 is shown in FIG. 2 in the first position, where a fluid flowing through the central flow passage 208 and the inner flow path 230 of the primary valve 224 is able to also flow through the inner flow path 248 of the secondary valve 226. In the second position, however, the secondary valve 226 is moved axially within the central flow passage 208 and one or more seals 252, such as an O-ring or the like, provide a sealed interface between the secondary valve 226 and the housing 202 that prevents the fluid from migrating past the secondary valve 226 in the downhole direction. In the illustrated embodiment, the seal 252 is shown as being arranged on the housing 202 (i.e., the lower sub 206), but could alternatively be carried on the body 246 of the secondary valve 226, without departing from the scope of the disclosure.

Figure 3B:
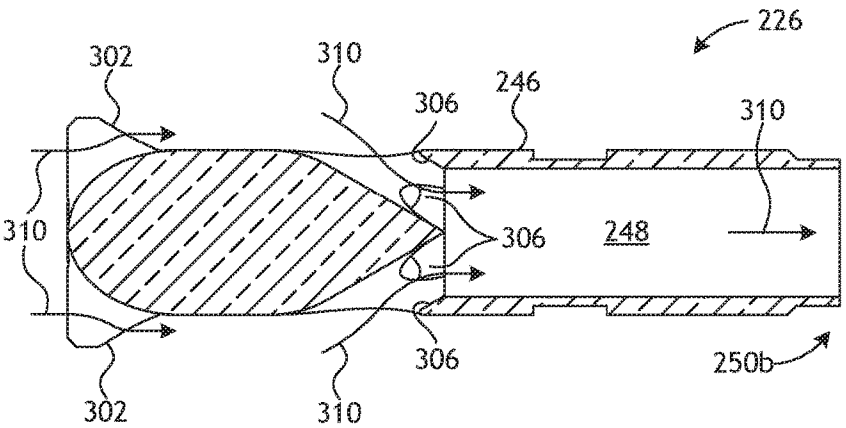
FIGS. 3A and 3B are isometric and cross-sectional views, respectively, of the secondary valve of FIG. 2.
Figure 3A:
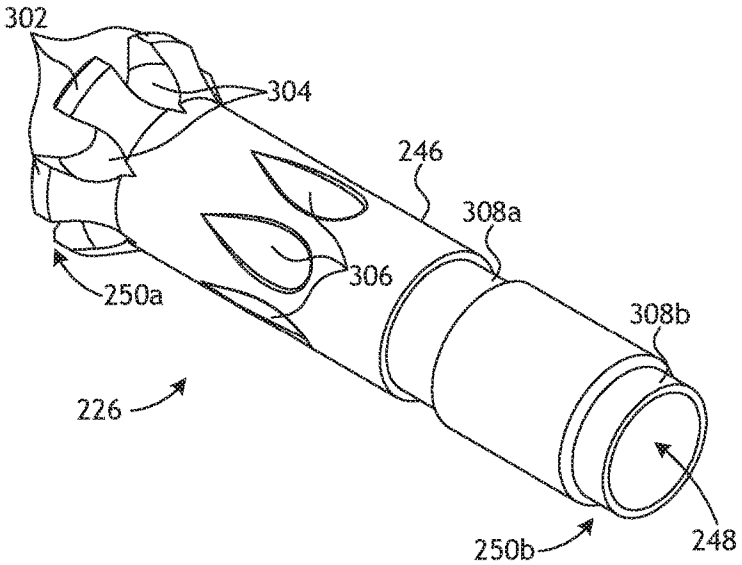

FIGS. 3A and 3B are isometric and cross-sectional views, respectively, of the secondary valve 226 of FIG. 2, according to one or more embodiments. As illustrated in FIG. 3A, the secondary valve 226 may provide a castellated first axial end 250*a*, which defines a plurality of radial extensions 302 angularly separated by a corresponding plurality of axial flow paths 304. One or more radial flow ports 306 are defined in the body 246 to facilitate fluid communication between the inner flow path 248 and the exterior of the body 246. In some embodiments, the radial flow ports 306 are equidistantly spaced from each other about the circumference of the body 246, but it is not necessary. The secondary valve 226 may also provide a first or "upper" lock ring groove 308*a* and a second or "lower" lock ring groove 308*b*, where each lock ring groove 308*a,b* is defined in the outer surface of the body 246 and axially offset from each other.

FIG. 3B depicts example flow of a fluid 310 through the secondary valve 226 when the secondary valve 226 is in the first position, as shown in FIG. 2. Upon encountering the secondary valve 226, the fluid 310 may flow around the radial extensions 302 by passing through the axial flow paths 304 (FIG. 3A). The fluid 310 then traverses along the exterior of the body 246 until encountering the radial flow ports 306, which provide access into the inner flow path 248 and allows the fluid 310 to circulate through the inner flow path 248 before being discharged from the secondary valve 226 at the second end 250*b*.

Figure 4:
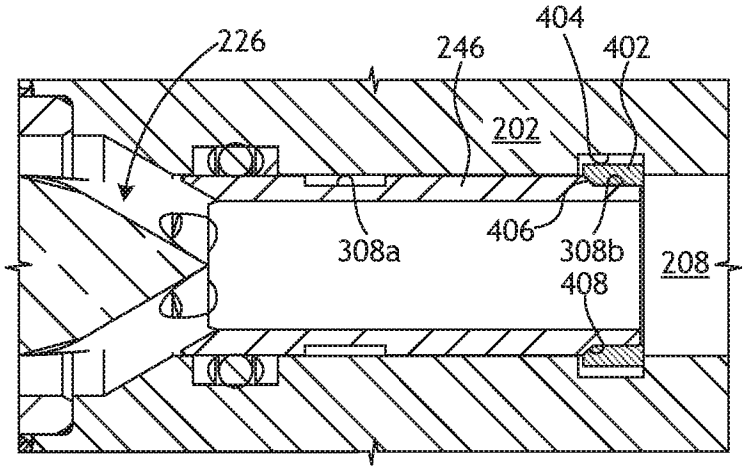
FIG. 4 is an enlarged view of the wellbore isolation device of FIG. 2, as indicated by the dashed box provided in FIG. 2.

FIG. 4 is an enlarged view of the wellbore isolation device 116 of FIG. 2, as indicated by the dashed box provided in FIG. 2. More specifically, FIG. 4 shows an enlarged view of the secondary valve 226 arranged within the central flow passage 208. As illustrated, the wellbore isolation device 116 may further include a lock ring 402 partially received within an inner groove 404 defined on the inner surface of the housing 202 within the central flow passage 208. The lock ring 402 may comprise, for example, a split C-ring, retaining ring, or the like. The lock ring 402 may be biased radially inward to naturally engage the secondary valve 226.

When the secondary valve 226 is in the first position, as shown in FIGS. 2 and 4, the lock ring 402 may be partially received within the lower lock ring groove 308*b*. Upon moving the secondary valve 226 downhole within the central flow passage 208 and to the second position, however, the lock ring 402 will radially expand and snap out of the lower lock ring groove 308*b* to be received within the upper lock ring groove 308*a*. The lock ring 402 may provide an angled uphole end 406 and the lower lock ring groove 308*b* may provide an angled downhole end 408. When the secondary valve 226 moves to the second position (i.e., to the right in FIG. 4), the uphole end 406 of the lower lock ring groove 308*b* engages the downhole end 408 of the lower lock ring groove 308*b*, which urges the lock ring 402 to radially expand out of the lower lock ring groove 308*b*. The secondary valve 226 may then be moved toward the second position and, upon encountering the upper lock ring groove 308*a*, the lock ring 402 is able to radially contract as it is received within the upper lock ring groove 308*a*.

Those skilled in the art will readily appreciate that the lock ring 402 and the corresponding inner groove 404 and upper and lower lock ring grooves 308*a,b* may be replaced with another type of locking mechanism or device that secures the secondary valve 226 in the second position. In some embodiments, for example, the secondary valve 226 may be secured in the second position with a ratcheting mechanism or collet having corresponding angled teeth defined on the outer radial surface of the body 246 and the inner radial surface of the central flow passage 208. The corresponding angled teeth may be angled to allow the secondary valve 226 to ratchet to the second position, but prevent the secondary valve 226 from retracting toward the first position.

Figure 5A:
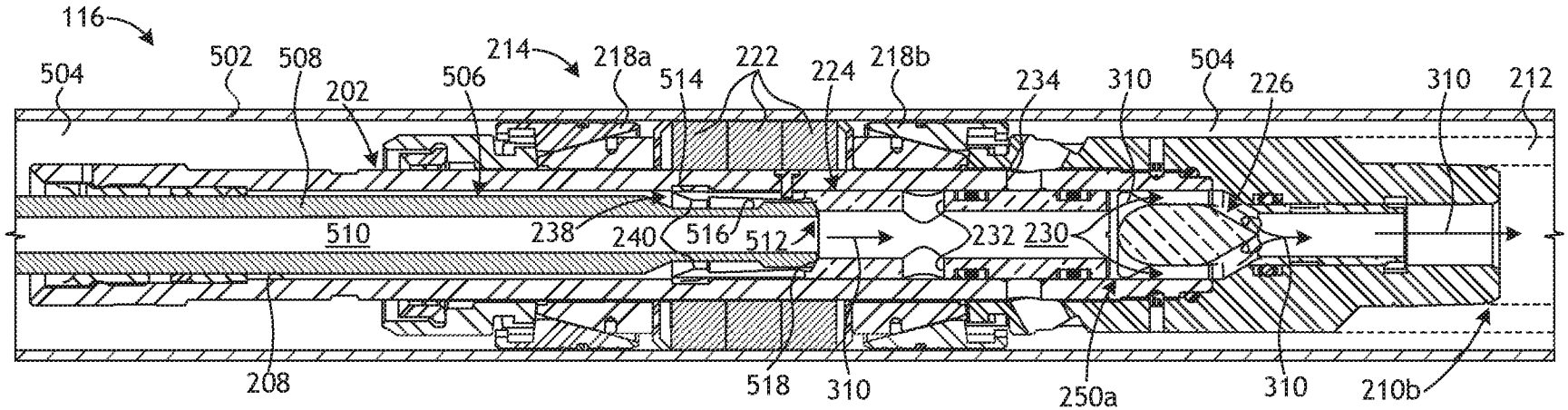
FIGS. 5A-5C depict example operation of the wellbore isolation device of FIG. 2.
Figure 5B:
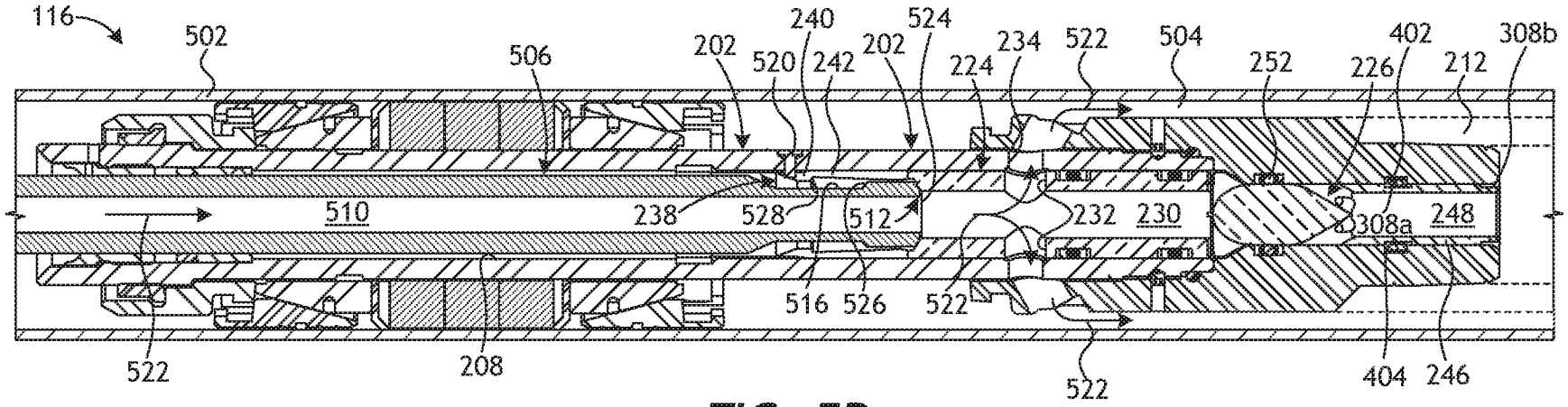
Figure 5C:
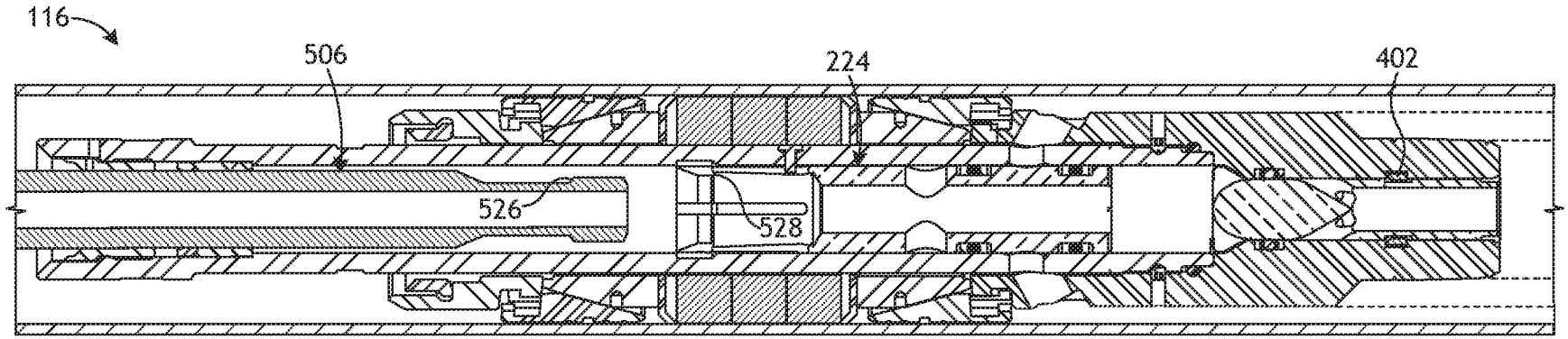

Example operation of the wellbore isolation device 116 of FIG. 2 is now provided with reference to FIGS. 5A-5C. In FIG. 5A, the wellbore isolation device 116 is shown actuated and otherwise "set" within a string of casing 502 that lines a wellbore (e.g., the wellbore 106 of FIG. 1). More specifically, the packer assembly 214 has been actuated such that the packer elements 222 are expanded radially into engagement with the inner wall of the casing 502 and the upper and lower slips 218*a,b* grippingly engage the inner surface of the casing 502. With the packer assembly 214 set, fluid migration within the wellbore annulus 504 and axially across the wellbore isolation device 116 is prevented. It should be noted that while shown set within the casing 502, it will be appreciated that the wellbore isolation device 116 may alternatively be set within an open hole section of the wellbore, without departing from the scope of the disclosure.

The primary valve 224 is shown in the first position, where the radial flow ports 232 are misaligned with the lateral flow ports 234 of the housing 202 and thereby prevents fluid communication between the central flow passage 208 and the annulus 504. The secondary valve 226 is also shown in the first position, which allows the fluid 310 to flow around and through the secondary valve 226, as generally described above. This may prove advantageous in allowing a well operator to circulate the fluid 310 through the wellbore isolation device 116 and into the tubing 212 coupled thereto at its downhole end 210*b*. In some applications, for example, the fluid 310 may be used to wash the wellbore (e.g., the wellbore 106 of FIG. 1) as the wellbore isolation device 116 is being run into the casing 502. This may prove advantageous in removing debris from the wellbore so that the packer assembly 214 can be set without obstruction. Accordingly, in at least one embodiment, the fluid 310 may comprise water, an acidizing solution, drilling fluid, or any combination thereof.

Moving the primary valve 224 to its second position simultaneously moves the secondary valve 226 to its second position, which stops further circulation of the fluid 310 through the wellbore isolation device 116 and into the tubing 212. To move the primary valve 224 to the second position, a stinger setting tool 506 may be conveyed to the wellbore isolation device 116 and received within (i.e., "stung" into) the central flow passage 208. The stinger setting tool 506 may be conveyed to the wellbore isolation device 116 as coupled to coiled tubing, drill pipe, production tubing, or any combination thereof.

As illustrated, the stinger setting tool 506 may comprise an elongate body 508 that defines an inner flow path 510 and provides a bullnose 512 at its distal end. As the stinger setting tool 506 extends into the central flow passage 208, the bullnose 512 eventually engages the primary valve 224 and, more particularly, the collet 238. Upon engaging the collet 238, the bullnose 512 may radially expand the collet fingers 240 into a collet groove 514 defined in the housing 202, which allows the bullnose 512 to extend into the inner flow path 230 of the primary valve 224. Once the bullnose 512 bypasses the collet fingers 240, the collet fingers 240 may be able to radially contract once again and be received within a collet profile 516 defined on the outer radial surface of the body 508 of the stinger setting tool 506. The collet profile 516 may comprise a reduced diameter portion of the body 508, for example.

The bullnose 512 may advance within the inner flow path 230 until engaging a radial shoulder 518 provided by the primary valve 224. Once the bullnose 512 engages the radial shoulder 518, any axial load provided to the stinger setting tool 506 in the downhole direction (i.e., to the right in FIG. 5A), will be transferred to the primary valve 224 and correspondingly urge the primary valve 224 to move in the same direction. As the primary valve 224 moves in the downhole direction toward its second position, it will eventually engage the first axial end 250*a* of the secondary valve 226 and transfer the axial load provided by the stinger setting tool 506 to the secondary valve 226. As a result, the secondary valve 226 is also moved in the downhole direction and to its second position under the axial load provided by the stinger setting tool 506.

FIG. 5B shows the primary and secondary valves 224, 226 moved to their respective second positions. The wellbore isolation device 116 may further include one or more alignment pins 520 (one shown) extending radially inward from the housing 202. The alignment pin 520 may be configured to extend into one of the slots 242 provided by the collet 238. As the primary valve 224 moves to the second position, the alignment pin 520 rides within the slot 242 to maintain a predetermined angular alignment between the primary valve 224 and the housing 202 such that the radial and lateral flow ports 232, 234 are able to align properly.

With the primary valve 224 in the second position, the radial flow ports 232 of the primary valve 224 align with the lateral flow ports 234 of the housing 202, which facilitates fluid communication between the central flow passage 208 and the annulus 504. Moreover, with the secondary valve 226 in its second position, the seal(s) 252 provides a sealed interface between the secondary valve 226 and the housing 202 and thereby prevents the fluid 310 (FIG. 5A) from migrating past the secondary valve 226 in the downhole direction. As a result, the tubing 212 coupled to the wellbore isolation device 116 will be isolated from any fluid flow through the wellbore isolation device 116.

With the primary and secondary valves 224, 226 moved to their respective second positions, a second fluid 522 may be introduced into the wellbore isolation device 116 via the stinger setting tool 506 and discharged into the annulus 504. More particularly, the fluid 522 may be conveyed through the inner flow path 510 of the stinger setting tool 506 and discharged into the inner flow path 230 of the primary valve 224 via an outlet 524 provided by the bullnose 512. With the seal(s) 252 providing a sealed interface between the secondary valve 226 and the housing 202, the fluid 522 is prevented from bypassing the secondary valve 226 and otherwise entering tubing 212. Instead, the fluid 522 will be diverted into the annulus 504 via the aligned radial and lateral flow ports 232, 234.

In some embodiments, the fluid 522 may be the same as the fluid 310 of FIG. 5A. In other embodiments, however, the fluid may comprise a cement slurry used in a cementing or squeeze operation and configured to seal a portion of the annulus 504.

Moving the secondary valve 226 to its second position may also permanently lock the secondary valve 226 in the second position, and thereby permanently isolate the inner flow path 248 from the central flow passage 208. As mentioned above, as the secondary valve 226 moves from the first position, as shown in FIGS. 4 and 5A, the lock ring 402 will expand radially outward and into the inner groove 404 and thereby disengage from the lower lock ring groove 308*b*. The lock ring 402 will then ride along the outer surface of the body 246 as the secondary valve 226 moves until locating and received within the upper lock ring groove 308*a*. Upon encountering the upper lock ring groove 308*a*, the lock ring 402 is able to radially contract and seat itself within the upper lock ring groove 308*a*, which prevents the secondary valve 226 from moving back to the first position.

After the fluid 522 is circulated into the annulus 504 via the aligned radial and lateral flow ports 232, 234 for the desired downhole operation, the primary valve 224 may be moved to seal the central flow passage 208. More specifically, the primary valve 224 may be moved to once again misalign the radial and lateral flow ports 232, 234 and prevent further fluid flow into the annulus 504. In some embodiments, this may be accomplished by retracting (pulling) the stinger running tool 506 in the uphole direction (i.e., to the left in FIG. 5B). In such embodiments, the primary valve 224 may be moved back to the first position or to a third position between the first and second positions. In other embodiments, however, and with a differently configured wellbore isolation device 116, the primary valve 224 may alternatively be moved to seal the central flow passage 208 by pushing the stinger running tool 506 in the downhole direction (i.e., to the right in FIG. 5B) and to a third position downhole from the second position where the radial and lateral flow ports 232, 234 are misaligned. As the stinger running tool 506 is pulled in the uphole direction, a radial shoulder 526 provided by the collet profile 516 will eventually engage an opposing downhole end 528 of the collet fingers 240. As a result, any axial load applied on the stinger running tool 506 in the uphole direction will be correspondingly applied to the primary valve 224 via the engagement between the radial shoulder 526 and the downhole end 528.

As the primary valve 224 is moved in the uphole direction toward the first position, the collet fingers 240 will eventually locate and engage the collet groove 514 defined in the housing 202, and thereby stop axial progress of the primary valve 224. More specifically, upon locating the collet groove 514, the collet fingers 240 may be naturally biased to expand radially outward and at least partially into the collet groove 514, which binds the collet 238 and stops movement of the primary valve 224. The stinger running tool 506 may be separated from the collet 238 and, therefore, the primary valve 224, by applying an additional axial load on the stinger running tool 506 in the uphole direction, which allows the bullnose 512 to snap through the collet 238. At least one of the radial shoulder 526 and the downhole end 528 of the collet 328 may have an angled surface that urges the collet fingers 240 to expand radially outward upon assuming the additional axial load provided by the stinger running tool 506. As the collet fingers 240 expand radially outward, the collet 238 is able to detach from the collet profile 516 and thereby separate the stinger running tool 506 from the primary valve 224.

FIG. 5C depicts the primary valve 224 moved back to the first position and the stinger setting tool 506 as having disengaged (separated) from the primary valve 224. The stinger running tool 506 may then be returned to the well surface and the primary valve 224 will remain closed in the first position until manipulated back to the second position, if needed.

Figure 6:
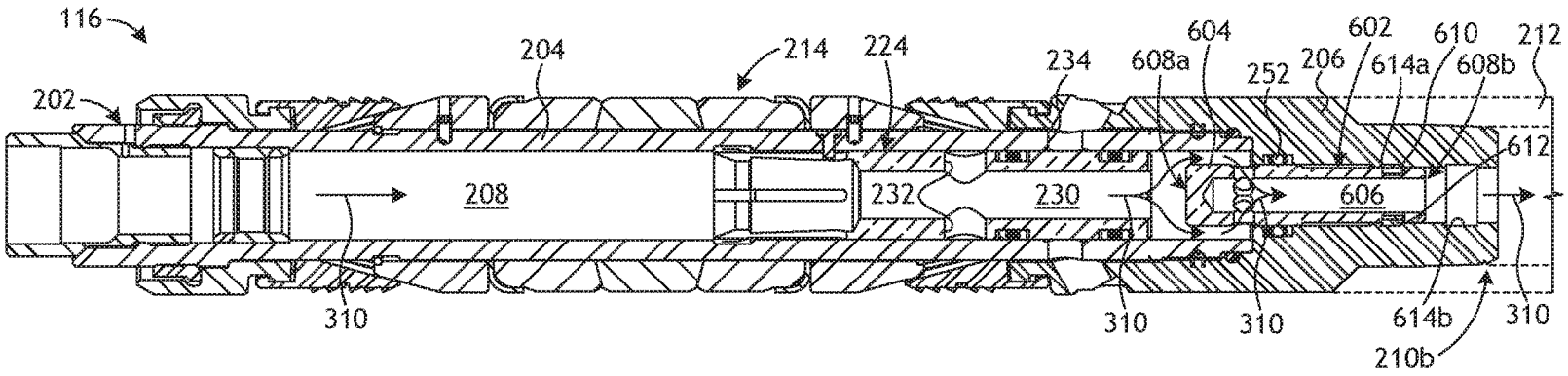
FIG. 6 is a cross-sectional side view of another example embodiment of the wellbore isolation device of FIG. 1.

FIG. 6 is a cross-sectional view of another example embodiment of the wellbore isolation device 116 of FIG. 1. The embodiment depicted in FIG. 6 may be similar in some respects to the embodiment of the wellbore isolation device 116 shown in FIGS. 2 and 5A-5C and, therefore, may be best understood with reference thereto, where like numerals will correspond to like components or elements that may not be described again. Similar to the wellbore isolation device 116 of FIGS. 2 and 5A-5C, for example, the wellbore isolation device 116 of FIG. 6 includes the elongate housing 202, including the mandrel 204 and the lower sub 206, and the packer assembly 214 arranged about the exterior of the housing 202. The wellbore isolation device 116 of FIG. 6 also includes the primary valve 224, as generally described above.

Unlike the wellbore isolation device 116 of FIGS. 2 and 5A-5C, however, the wellbore isolation device 116 of FIG. 6 includes a secondary valve 602 that is different from the secondary valve 226. The secondary valve 602 is axially offset downhole from the primary valve 224 within the central flow passage 208 and provides an elongate body 604 that defines an inner flow path 606. The body 604 provides a first axial end 608*a* and a second axial end 608*b* opposite the first axial end 608*b*.

The secondary valve 602 is axially movable within the central flow passage 208 between a first position and a second position. The secondary valve 602 is shown in FIG. 6 in the first position, where fluids flowing through the central flow passage 208 and the inner flow path 230 of the primary valve 224 are able to also access and circulate through the inner flow path 606 of the secondary valve 602. In the second position, however, the secondary valve 602 is moved axially within the central flow passage 208 such that the seal(s) 252 provides a sealed interface between the secondary valve 602 and the housing 202. As a result, fluids are prevented from migrating past the secondary valve 602 in the downhole direction when the secondary valve 602 is in the second position.

The wellbore isolation device 116 may further include a lock ring 610 partially received within a lock ring groove 612 defined on the outer surface of the body 604 of the secondary valve 602. Similar to the lock ring 402 of FIG. 4, the lock ring 610 may comprise, for example, a split C-ring, retaining ring, or the like. Unlike the lock ring 402 of FIG. 4, however, the lock ring 610 may be naturally biased radially outward.

When the secondary valve 602 is in the first position, as shown in FIG. 6, the lock ring 610 may be partially received within a first or "upper" inner groove 614*a* defined on the inner surface of the housing 202 within the central flow passage 208. Upon moving the secondary valve 602 downhole within the central flow passage 208 (i.e., to the right in FIG. 6) and toward the second position, however, the lock ring 610 will radially contract into the lock ring groove 612 and snap out of the upper inner groove 614*a*. In some embodiments, the lock ring 610 may provide an angled downhole end that helps urge the lock ring 610 to radially contract into the lock ring groove 612 and out engagement with the upper inner groove 614*a*. As the secondary valve 602 moves to the second position, the lock ring 610 will eventually locate and be received within a second or "lower" inner groove 614*b* defined on the inner surface of the housing 202 downhole from the upper inner groove 614*a*. More specifically, upon encountering the lower inner groove 614*b*, the lock ring 610 is able to radially expand as it is received within the lower inner groove 614*b*.

Figure 7B:
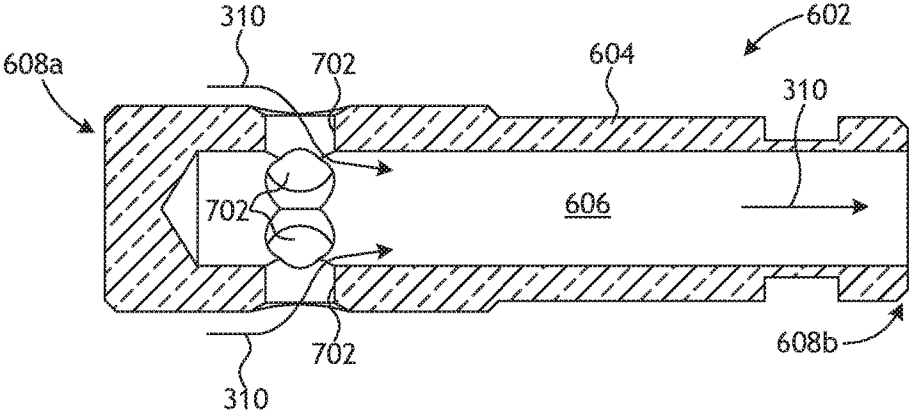
FIGS. 7A and 7B are isometric and cross-sectional views, respectively, of the secondary valve of FIG. 6.
Figure 7A:
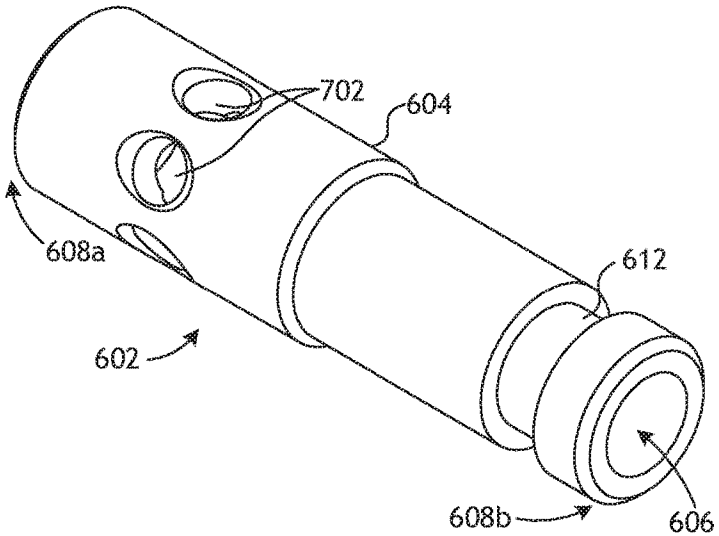

FIGS. 7A and 7B are isometric and cross-sectional views, respectively, of the secondary valve 602 of FIG. 6, according to one or more embodiments. As illustrated in FIG. 7A, one or more radial flow ports 702 are defined in the body 604 to facilitate fluid communication between the inner flow path 606 and the exterior of the body 604. In some embodiments, the radial flow ports 702 are equidistantly spaced from each other about the circumference of the body 604, but it is not necessary. The lock ring groove 612 is also shown defined on the body 604 of the secondary valve 602 at an intermediate location between the first and second axial ends 608*a,b*.

FIG. 7B depicts example flow of the fluid 310 through the secondary valve 602 when the secondary valve 602 is in the first position. Upon encountering the secondary valve 602, the fluid 310 flows around the first axial end 608*a* and traverses the exterior of the body 604 for a short distance until encountering the radial flow ports 702. The fluid 310 may enter the inner flow path 606 via the radial flow ports 702 and circulate through the inner flow path 606 before being discharged from the secondary valve 602 at the second end 608*b*.

Similar to the secondary valve 226 of FIGS. 5A-5C, those skilled in the art will readily appreciate that the lock ring 610 and the corresponding lock ring groove 612 and upper and lower inner grooves 614*a,b* may be replaced with another type of locking mechanism or device that secures the secondary valve 602 in the second position. In some embodiments, for example, the secondary valve 602 may be secured in the second position with a ratcheting mechanism or collet having corresponding angled teeth defined on the outer radial surface of the body 604 and the inner radial surface of the central flow passage 208. The corresponding angled teeth may be angled to allow the secondary valve 602 to ratchet to the second position, but prevent the secondary valve 602 from retracting toward the first position.

Example operation of the wellbore isolation device 116 of FIG. 6 is now provided with reference to FIGS. 6 and 8A-8C. In FIG. 6, the primary valve 224 is shown in the first position, where the radial flow ports 232 are misaligned with the lateral flow ports 234 of the housing 202 and thereby prevents fluid communication between the central flow passage 208 and the exterior of the wellbore isolation device 116 (e.g., the annulus 504 of FIGS. 5A-5C). The secondary valve 602 is also shown in the first position, which allows the fluid 310 to flow around and through the secondary valve 602, as generally described above. Fluid discharged from the secondary valve 602 may be circulated to the tubing 212 coupled to the housing 202 at the downhole end 210*b* and used for various wellbore operations, as described above.

Moving the primary valve 224 to its second position simultaneously moves the secondary valve 602 to its second position, which ceases circulation of the fluid 310 into the tubing 212. To move the primary valve 224 to the second position, the stinger setting tool 506 (FIGS. 5A-5C) may again be used, as generally described above. Any axial load provided to the stinger setting tool 506 in the downhole direction (i.e., to the right in FIG. 6), will be transferred to the primary valve 224 and correspondingly urge the primary valve 224 to move in the same direction. As it moves in the downhole direction toward its second position, the primary valve 224 engages the first axial end 608*a* of the secondary valve 602 and transfers the axial load provided by the stinger setting tool 506 to the secondary valve 602. As a result, the secondary valve 602 is also moved in the downhole direction and to its second position under the axial load provided by the stinger setting tool 506.

Figure 8A:
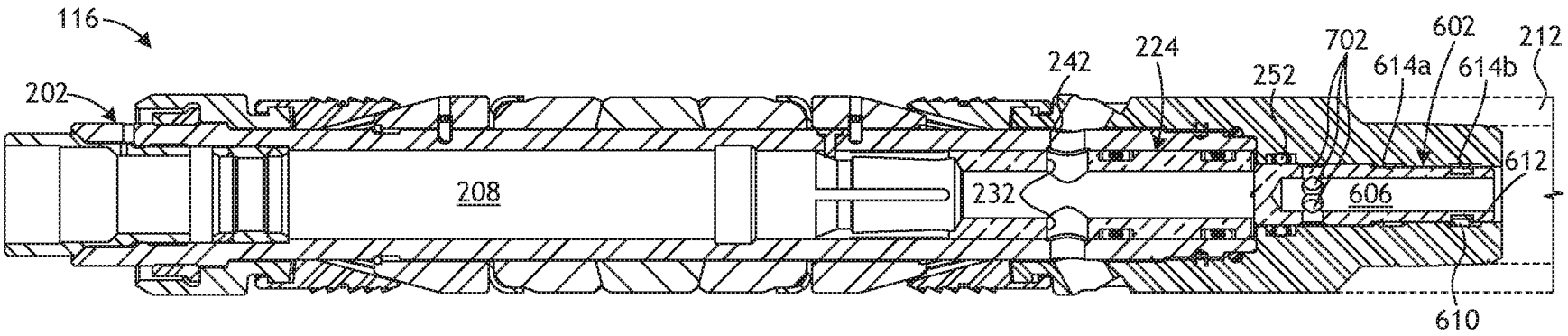
FIGS. 8A and 8B, on conjunction with FIG. 6, depict example operation of the wellbore isolation device of FIG. 6.

FIG. 8A shows the primary and secondary valves 224, 602 moved to their respective second positions. With the primary valve 224 in the second position, the radial flow ports 232 of the primary valve 224 align with the lateral flow ports 234 of the housing 202, which facilitates fluid communication between the central flow passage 208 and the exterior of the wellbore isolation device 116 (e.g., the annulus 504 of FIGS. 5A-5C). Moreover, with the secondary valve 602 in its second position, the seal(s) 252 provides a sealed interface between the secondary valve 602 and the housing 202 uphole from the radial flow ports 702 of the secondary seal 602. As a result, any fluids circulated into the wellbore isolation device 116 are prevented from migrating past the secondary valve 602 in the downhole direction. Consequently, the tubing 212 will be isolated from any fluid flow through the wellbore isolation device 116.

With the primary and secondary valves 224, 602 moved to their respective second positions, a second fluid (e.g., the second fluid 522 of FIG. 5B) may then be circulated into the wellbore isolation device 116 and discharged into the exterior of the wellbore isolation device 116 (e.g., the annulus 504 of FIGS. 5A-5C) via the aligned radial and lateral flow ports 232, 234, as generally described above. This second fluid (e.g., a cement slurry) may be used for various wellbore operations, as described above.

Moving the secondary valve 602 to its second position may also permanently lock the secondary valve 602 in the second position, and thereby permanently isolate the inner flow path 606 from the central flow passage 208. As the secondary valve 602 moves from the first position, the lock ring 610 will radially contract into the lock ring groove 612 and thereby disengage from the upper inner groove 614*a*. The lock ring 610 will then remain radially contracted within the lock ring groove 612 as the secondary valve 602 moves toward the second position and until locating and being received within the lower lock ring groove 614*b*. Upon encountering the lower lock ring groove 614*b*, the lock ring 610 is able to radially expand and seat itself partially within the lower lock ring groove 614*b*, which prevents the secondary valve 602 from moving back to the first position.

Following a desired downhole operation that requires the radial and lateral flow ports 232, 234 (e.g., a cementing operation or the like) to be aligned, the primary valve 224 may be moved back to the first position and thereby prevent further fluid flow to the exterior of the wellbore isolation device 116. This may be accomplished by retracting (pulling) the stinger running tool 506 (FIGS. 5A-5C) in the uphole direction (i.e., to the left in FIG. 8A), as generally described above.

Figure 8B:
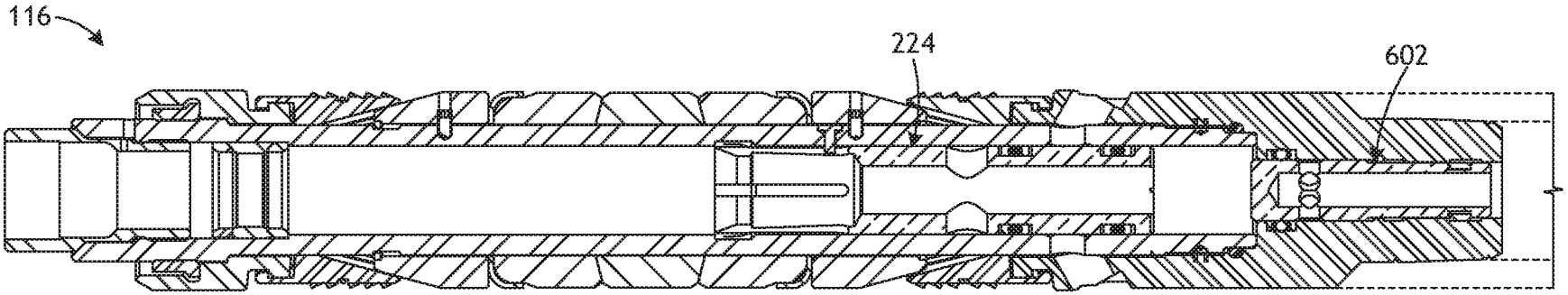

FIG. 8B depicts the primary valve 224 moved back to the first position where the radial and lateral flow ports 232, 234 are misaligned. As the primary valve 224 moves back to the first position, the secondary valve 602 remains in the second position.

Embodiments Disclosed Herein Include:

A. A method that includes conveying a wellbore isolation device into a wellbore, the wellbore isolation device including a primary valve arranged within a central flow passage, circulating a fluid through the central flow passage and into a tubing attached to a downhole end of the wellbore isolation device and in fluid communication with the central flow passage, moving the primary valve from a first position to a second position and thereby diverting the fluid into an annulus defined between the wellbore and the wellbore isolation device, and moving the primary valve to seal the central flow passage and thereby prevent the fluid from flowing into the annulus or into the tubing.

B. A wellbore isolation device that includes a housing that defines a central flow passage and one or more lateral flow ports that facilitate fluid communication between the central flow passage and an exterior of the housing, a packer assembly positioned circumferentially about the housing, a primary valve positioned within the central flow passage and defining one or more radial flow ports, the primary valve being movable between a first position, where the one or more radial flow ports are misaligned with the one or more lateral flow ports, and a second position, where the one or more radial flow ports are aligned with the one or more lateral flow ports, and a secondary valve positioned within the central flow passage downhole from the primary valve and being movable between a first position, where a fluid flowing through the central flow passage and the primary valve is able to circulate through the secondary valve, and a second position, where the fluid is prevented from flowing through the secondary valve.

C. A well system that includes a wellbore isolation device positioned within a wellbore and including a housing that defines a central flow passage and one or more lateral flow ports that facilitate fluid communication between the central flow passage and an annulus defined between the wellbore and the housing, a packer assembly positioned circumferentially about the housing and engageable against an inner wall of the wellbore, a primary valve positioned within the central flow passage and defining one or more radial flow ports, the primary valve being movable between a first position, where the one or more radial flow ports are misaligned with the one or more lateral flow ports, and a second position, where the one or more radial flow ports are aligned with the one or more lateral flow ports, and a secondary valve positioned within the central flow passage downhole from the primary valve and being movable between a first position, where a fluid flowing through the central flow passage and the primary valve is able to circulate through the secondary valve, and a second position, where the fluid is prevented from flowing through the secondary valve, a string of tubing attached to a downhole end of the housing and in fluid communication with the central flow passage when the secondary valve is in the first position and isolated from the central flow passage when the secondary valve is in the second position, and a stinger setting tool receivable within the central flow passage to move the primary valve between the first and second positions, wherein moving the primary valve to the second position correspondingly moves the secondary valve to the second position.

Each of embodiments A, B, and C may have one or more of the following additional elements in any combination: Element 1: wherein the wellbore isolation device includes a housing that defines the central flow passage and one or more lateral flow ports, and a secondary valve positioned within the central flow passage downhole from the primary valve, and wherein moving the primary valve from the first position to the second position comprises moving the primary valve to align one or more radial flow ports defined in the primary valve with the one or more lateral flow ports, and engaging the primary valve on the secondary valve as the primary valve moves and thereby moving the secondary valve to seal the central flow passage below the primary valve and prevent the first fluid from entering the tubing. Element 2: wherein diverting the fluid into the annulus comprises circulating the fluid to the wellbore isolation device and into the annulus via the one or more radial flow ports aligned with the one or more lateral flow ports. Element 3: wherein the wellbore isolation device further includes a lock ring partially received within an inner groove defined within the central flow passage and biased radially inward, and wherein moving the secondary valve to seal the central flow passage comprises disengaging the lock ring from a lower lock ring groove defined on an outer surface of the secondary valve, and receiving the lock ring within an upper lock ring groove defined on the outer surface of the secondary valve. Element 4: wherein the wellbore isolation device further includes a lock ring partially received within a lock ring groove defined on an outer surface of the secondary valve and biased radially outward, and wherein moving the secondary valve to seal the central flow passage comprises disengaging the lock ring from an upper inner groove defined within the central flow passage, and receiving the lock ring within a lower inner groove defined within the central flow passage. Element 5: further comprising circulating the fluid through the wellbore isolation device and into the tubing while the wellbore isolation device is conveyed into the wellbore. Element 6: wherein moving the primary valve to seal the central flow passage comprises moving the primary valve back to the first position.

Element 7: wherein the secondary valve comprises a body defining an inner flow path and one or more radial flow ports, wherein, when the secondary valve is in the first position, the inner flow path of the secondary valve fluidly communicates with an inner flow path of the primary valve via the one or more radial flow ports of the secondary valve. Element 8: further comprising a seal arranged within the central flow passage to provide a sealed interface between the body of the secondary valve and the housing when the secondary valve is in the second position, wherein the sealed interface prevents the fluid from flowing through the secondary valve. Element 9: wherein the secondary valve further comprises an axial end that defines a plurality of radial extensions angularly separated by a corresponding plurality of axial flow paths. Element 10: further comprising a lock ring partially received within an inner groove defined within the central flow passage and biased radially inward, a lower lock ring groove defined on an outer surface of the secondary valve to partially receive the lock ring when the secondary valve is in the first position, and an upper lock ring groove defined on the outer surface of the secondary valve to partially receive the lock ring when the secondary valve is in the second position. Element 11: further comprising a lock ring partially received within a lock ring groove defined on an outer surface of the secondary valve and biased radially outward, an upper inner groove defined within the central flow passage to partially receive the lock ring when the secondary valve is in the first position, and a lower inner groove defined within the central flow passage to partially receive the lock ring when the secondary valve is in the second position. Element 12: wherein the primary valve comprises a body that defines an inner flow path of the primary valve and includes a first axial end and a second axial end opposite the first axial end, and a collet provided at the first axial end.

Element 13: wherein the secondary valve comprises a body defining an inner flow path and one or more radial flow ports, wherein, when the secondary valve is in the first position, the inner flow path of the secondary valve fluidly communicates with an inner flow path of the primary valve via the one or more radial flow ports of the secondary valve. Element 14: further comprising a seal arranged within the central flow passage to provide a sealed interface between the body of the secondary valve and the housing when the secondary valve is in the second position, wherein the sealed interface prevents the fluid from flowing through the secondary valve. Element 15: further comprising a lock ring partially received within an inner groove defined within the central flow passage and biased radially inward, a lower lock ring groove defined on an outer surface of the secondary valve to partially receive the lock ring when the secondary valve is in the first position, and an upper lock ring groove defined on the outer surface of the secondary valve to partially receive the lock ring when the secondary valve is in the second position. Element 16: further comprising a lock ring partially received within a lock ring groove defined on an outer surface of the secondary valve and biased radially outward, an upper inner groove defined within the central flow passage to partially receive the lock ring when the secondary valve is in the first position, and a lower inner groove defined within the central flow passage to partially receive the lock ring when the secondary valve is in the second position. Element 17: wherein the primary valve comprises a body that defines an inner flow path of the primary valve and includes a first axial end and a second axial end opposite the first axial end, and a collet provided at the first axial end to receive a bullnose of the stinger setting tool.

By way of non-limiting example, exemplary combinations applicable to A, B, and C include: Element 1 with Element 2; Element 1 with Element 3; Element 1 with Element 4; Element 7 with Element 8; and Element 13 with Element 14.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method, comprising:

conveying a wellbore isolation device into a wellbore, the wellbore isolation device including a primary valve arranged within a central flow passage;

circulating a fluid through the central flow passage and into a tubing attached to a downhole end of the wellbore isolation device and in fluid communication with the central flow passage;

moving the primary valve from a first position to a second position and thereby diverting the fluid into an annulus defined between the wellbore and the wellbore isolation device; and moving a secondary valve in response to moving the primary valve to seal the central flow passage and thereby prevent the fluid from flowing into the annulus and into the tubing.

2. The method of claim 1, wherein the wellbore isolation device includes a housing that defines the central flow passage and one or more lateral flow ports, and the secondary valve positioned within the central flow passage downhole from the primary valve, and wherein moving the primary valve from the first position to the second position comprises:

moving the primary valve to align one or more radial flow ports defined in the primary valve with the one or more lateral flow ports; and engaging the primary valve on the secondary valve as the primary valve moves and thereby moving the secondary valve to seal the central flow passage below the primary valve and prevent the first fluid from entering the tubing.

3. The method of claim 2, wherein diverting the fluid into the annulus comprises circulating the fluid to the wellbore isolation device and into the annulus via the one or more radial flow ports aligned with the one or more lateral flow ports.

4. The method of claim 2, wherein the wellbore isolation device further includes a lock ring partially received within an inner groove defined within the central flow passage and biased radially inward, and wherein moving the secondary valve to seal the central flow passage comprises;

disengaging the lock ring from a lower lock ring groove defined on an outer surface of the secondary valve; and receiving the lock ring within an upper lock ring groove defined on the outer surface of the secondary valve.

5. The method of claim 2, wherein the wellbore isolation device further includes a lock ring partially received within a lock ring groove defined on an outer surface of the secondary valve and biased radially outward, and wherein moving the secondary valve to seal the central flow passage comprises;

disengaging the lock ring from an upper inner groove defined within the central flow passage; and receiving the lock ring within a lower inner groove defined within the central flow passage.

6. The method of claim 1, further comprising circulating the fluid through the wellbore isolation device and into the tubing while the wellbore isolation device is conveyed into the wellbore.

7. The method of claim 1, wherein moving the primary valve to seal the central flow passage comprises moving the primary valve back to the first position.

8. A wellbore isolation device, comprising:

a housing that defines a central flow passage and one or more lateral flow ports that facilitate fluid communication between the central flow passage and an exterior of the housing;

a packer assembly positioned circumferentially about the housing;

a primary valve positioned within the central flow passage and defining one or more radial flow ports, the primary valve being movable between a first position, where the one or more radial flow ports are misaligned with the one or more lateral flow ports, and a second position, where the one or more radial flow ports are aligned with the one or more lateral flow ports; and a secondary valve positioned within the central flow passage downhole from the primary valve and being movable between a first position, where a fluid flowing through the central flow passage and the primary valve is able to circulate through the secondary valve, and a second position, where the fluid is prevented from flowing through the secondary valve;

wherein the secondary valve comprises a body defining an inner flow path and one or more radial flow ports, wherein, when the secondary valve is in the first position, the inner flow path of the secondary valve fluidly communicates with an inner flow path of the primary valve via the one or more radial flow ports of the secondary valve.

9. The wellbore isolation device of claim 8, further comprising a seal arranged within the central flow passage to provide a sealed interface between the body of the secondary valve and the housing when the secondary valve is in the second position, wherein the sealed interface prevents the fluid from flowing through the secondary valve.

10. The wellbore isolation device of claim 8, wherein the secondary valve further comprises an axial end that defines a plurality of radial extensions angularly separated by a corresponding plurality of axial flow paths.

11. The wellbore isolation device of claim 8, further comprising:

a lock ring partially received within an inner groove defined within the central flow passage and biased radially inward;

a lower lock ring groove defined on an outer surface of the secondary valve to partially receive the lock ring when the secondary valve is in the first position; and an upper lock ring groove defined on the outer surface of the secondary valve to partially receive the lock ring when the secondary valve is in the second position.

12. The wellbore isolation device of claim 8, further comprising:

a lock ring partially received within a lock ring groove defined on an outer surface of the secondary valve and biased radially outward;

an upper inner groove defined within the central flow passage to partially receive the lock ring when the secondary valve is in the first position; and a lower inner groove defined within the central flow passage to partially receive the lock ring when the secondary valve is in the second position.

13. The wellbore isolation device of claim 8, wherein the primary valve comprises:

a body that defines an inner flow path of the primary valve and includes a first axial end and a second axial end opposite the first axial end; and a collet provided at the first axial end.

14. A well system, comprising:

a wellbore isolation device positioned within a wellbore and including:

a housing that defines a central flow passage and one or more lateral flow ports that facilitate fluid communication between the central flow passage and an annulus defined between the wellbore and the housing;

a packer assembly positioned circumferentially about the housing and engageable against an inner wall of the wellbore;

a primary valve positioned within the central flow passage and defining one or more radial flow ports, the primary valve being movable between a first position, where the one or more radial flow ports are misaligned with the one or more lateral flow ports, and a second position, where the one or more radial flow ports are aligned with the one or more lateral flow ports; and a secondary valve positioned within the central flow passage downhole from the primary valve and being movable between a first position, where a fluid flowing through the central flow passage and the primary valve is able to circulate through the secondary valve, and a second position, where the fluid is prevented from flowing through the secondary valve, a string of tubing attached to a downhole end of the housing and in fluid communication with the central flow passage when the secondary valve is in the first position and isolated from the central flow passage when the secondary valve is in the second position; and a stinger setting tool receivable within the central flow passage to move the primary valve between the first and second positions, wherein moving the primary valve to the second position correspondingly moves the secondary valve to the second position;

wherein the secondary valve comprises a body defining an inner flow path and one or more radial flow ports, wherein, when the secondary valve is in the first position, the inner flow path of the secondary valve fluidly communicates with an inner flow path of the primary valve via the one or more radial flow ports of the secondary valve.

15. The well system of claim 14, further comprising a seal arranged within the central flow passage to provide a sealed interface between the body of the secondary valve and the housing when the secondary valve is in the second position, wherein the sealed interface prevents the fluid from flowing through the secondary valve.

16. The well system of claim 14, further comprising:

a lock ring partially received within an inner groove defined within the central flow passage and biased radially inward;

a lower lock ring groove defined on an outer surface of the secondary valve to partially receive the lock ring when the secondary valve is in the first position; and an upper lock ring groove defined on the outer surface of the secondary valve to partially receive the lock ring when the secondary valve is in the second position.

17. The well system of claim 14, further comprising:

a lock ring partially received within a lock ring groove defined on an outer surface of the secondary valve and biased radially outward;

an upper inner groove defined within the central flow passage to partially receive the lock ring when the secondary valve is in the first position; and a lower inner groove defined within the central flow passage to partially receive the lock ring when the secondary valve is in the second position.

18. The well system of claim 14, wherein the primary valve comprises:

a body that defines an inner flow path of the primary valve and includes a first axial end and a second axial end opposite the first axial end; and a collet provided at the first axial end to receive a bullnose of the stinger setting tool.

19. The well system of claim 14, wherein the secondary valve further comprises an axial end that defines a plurality of radial extensions angularly separated by a corresponding plurality of axial flow paths.

20. The well system of claim 14, wherein the primary valve comprises a collet to receive a bullnose of the stinger setting tool.

* * * * *